US006384582B2

(12) United States Patent
Munck

(10) Patent No.: US 6,384,582 B2
(45) Date of Patent: May 7, 2002

(54) CONTROLLED CURRENT SOURCES OF TWO-WIRE MEASURING INSTRUMENTS

(75) Inventor: Bertrand Munck, Loerrach (DE)

(73) Assignee: Endress + Hauser Flowtec AG, Reinach (CH)

( * ) Notice: Subject to any disclaimer, the term of this patent is extended or adjusted under 35 U.S.C. 154(b) by 0 days.

(21) Appl. No.: 09/836,782

(22) Filed: Apr. 17, 2001

Related U.S. Application Data

(60) Provisional application No. 60/226,812, filed on Aug. 22, 2000.

(30) Foreign Application Priority Data

May 19, 2000 (EP) ..... 00110732

(51) Int. Cl.[7] ..... G05F 1/40; G05F 1/565; G05F 1/573

(52) U.S. Cl. ..... 323/268; 323/275; 323/277

(58) Field of Search ..... 323/268, 273, 323/274, 277, 275, 276

(56) References Cited

U.S. PATENT DOCUMENTS

| | | | | |
|---|---|---|---|---|
| 4,881,262 A | * | 11/1989 | Meschkat et al. | 379/402 |
| 5,446,380 A | | 8/1995 | Theus et al. | 323/275 |
| 5,742,225 A | * | 4/1998 | Wetzel et al. | 340/310.02 |
| 5,790,046 A | * | 8/1998 | Blossfeld | 340/825.07 |

FOREIGN PATENT DOCUMENTS

| | | | |
|---|---|---|---|
| DE | 19636838 | 1/1998 | G06F/1/26 |
| DE | 19818315 | 9/1999 | G01D/5/14 |
| EP | 0 310 279 | 4/1989 | G08C/15/06 |
| EP | 0 901 014 | 3/1999 | G01N/27/49 |
| GB | 2 035 626 | 6/1980 | G05F/1/58 |

* cited by examiner

*Primary Examiner*—Bao Q. Vu
(74) *Attorney, Agent, or Firm*—Bose McKinney & Evans LLP

(57) ABSTRACT

These sources are so designed that the amount of power required at turn-on of the DC voltage source is greater than during normal operation, taht the power supply for the evaluation electronics is independent of the measured value, and that the so-called HART protocol can be trans-mitted over the two wires. A first variant of the sources has a first current path, which goes from terminal (P1) via diode (D), the emitter-collector path of transistor (T1), grounded voltage regulator (SR), and grounded current-sensing resistor (Rm) to terminal (P2) of the DC voltage source, and a second current path, which goes from terminal (P1) via diode (D), the emitter-base path of transistor (T1), resistor (R1), the collector-emitter path of transistor (T2), resistor (R2), and resistor (Rm) to terminal (P2). Feedback resistor (Rr) connects terminal (P2) to one of the inputs of operational amplifier (OP) fed by a control signal and the output of which being connected to the base of transistor (T2). Transistor (T) renders transistor (T1) conductive after turn-on. The emitter-collector path of transistor (T2) is connected in parallel with the controlled current path of transistor (T); its gate is connected to a tap of the RC section containing capacitor (C1) and resistor (Rs) being connected to the collector of transistor (T1). With a second variant, transistor (T) is replaced by transistors (TT1, TT2).

23 Claims, 2 Drawing Sheets

CONTROLLED CURRENT SOURCES OF TWO-WIRE MEASURING INSTRUMENTS

This application claims the benefit of U.S. Provisional application Ser. No. 60/226,812, filed Aug. 22, 2000.

BACKGROUND AND SUMMARY OF THE INVENTION

This invention relates to controlled current sources of two-wire measuring instruments which generate a measurement signal in the form of an output current between 4 mA and 20 mA and which are controlled by a control signal derived from an output signal of a physical-to-electrical transducer.

Industrial measuring instruments as are described herein measure at least one physical quantity, such as the volumetric or mass flow rate of a fluid, the density, viscosity, pressure, or temperature of a fluid, the pressure difference between two media, or, quite generally, temperature, pressure, level, pH value, or gas concentration.

A conunon feature of such instruments is that a physical-to-electrical transducer delivers a signal that is converted by means of evaluation electronics to a measurement signal suitable for transmission and further processing.

Most of these instruments are designed as four-wire devices. Two of the four wires serve to supply power to the instrument, and the other two wires serve to transmit the meaasurement signal.

Less common are two-wire instruments, in which the two wires must be used both for the supply of power, which necessitates connecting an external DC voltage source to the two wires, and for the transmission of the measurement signal.

The measurement signal provided by the two-wire instrument is practically always an output current between 4 mA and 20 mA, with a particular current value within this range corresponding exactly to a measurement signal value. The current range below 4 mA is available for the supply of power to the evaluation electronics, which are also present in two-wire instruments.

Two-wire instruments require much less power than the aforementioned four-wire instruments; the power is composed of the aforementioned supply power for the evaluation electronics and the power corresponding to each current value.

Two-wire instruments are especially suited for use in hazardous areas. A difficulty is, however, that when such instruments are turned on, the small amount of supply power suffices for the evaluation electronics, but does not suffice to start the controlled current source.

Another disadvantage of two-wire instruments is that the supply power for the evaluation electronics varies with the measurement signal, i.e., in the case of a flow rate measurement with the flow rate. Therefore, a constant power supply for the evaluation electronics which is independent of the measurement signal, e.g., the flow rate, is desirable.

It is therefore an object of the invention to provide improved controlled current sources of two-wire instruments wherein the amount of power required at turn-on of the DC voltage source, which is greater than during normal operation, is made available, so that the controlled current source begins to operate automatically.

Furthermore, the supply power for the evaluation electronics is to be constant, i.e., independent of the measured value. In addition, a current source is to be provided which, besides attaining the above objects, is so designed that the so-called HART protocol can be transmitted over the two wires (HART is a registered trademark of the HART User Group).

To attain these objects, a first variant of the invention provides a controlled current source of a two-wire measuring instrument which generates a measurement signal in the form of an output current between 4 mA and 20 mA and which is controlled by a control signal derived from an output signal of a physical-to-electrical transducer, said controlled current source comprising:

a first current path, which goes from a first terminal of a DC voltage source, to be connected from outside, via a diode, an emitter-collector path of a first bipolar transistor, a voltage regulator connected to ground, and a grounded current-sensing resistor to a second terminal of the DC voltage source;

a second current path, which goes from the first terminal via the diode, the emitter-base path of the first bipolar transistor, a first resistor, a collector-emitter path of a second bipolar transistor, whose conductivity type is complementary to that of the first bipolar transistor, a second resistor, and the current-sensing resistor to the second terminal, with the current in the first current path and the current in the second current path adding to the output current;

a feedback path for the output current which goes from the second terminal through a feedback resistor to a noninverting input of an operational amplifier, said noninverting input also receiving the control signal, and an output of the operational amplifier being connected to the base of the second bipolar transistor; and a transistor which renders the first bipolar transistor conductive after turn-on of the DC voltage source, said transistor having its controlled current path connected in parallel with the emitter-collector path of the second bipolar transistor and having its control electrode connected to a tap of a first RC section, containing a series resistor and a first capacitor, the series resistor being connected to the collector of the first bipolar transistor, and the capacitor being connected to ground.

To attain the above objects, a second variant of the invention provides a controlled current source of a two-wire measuring instrument which generates a measurement signal in the form of an output current between 4 mA and 20 mA and which is controlled by a control signal derived from an output signal of a physical-to-electrical transducer, said controlled current source comprising:

a first current path, which goes from a first terminal of a DC voltage source, to be connected from outside, via a first diode, an emitter-collector path of a first bipolar transistor, a voltage regulator connected to ground, and a grounded current-sensing resistor to a second terminal of the DC voltage source;

a second current path, which goes from the first terminal via the first diode, the emitter-base path of the first bipolar transistor, a first resistor, a collector-emitter path of a second bipolar transistor, whose conductivity type is complementary to that of the first bipolar transistor, a second resistor, and the current-sensing resistor to the second terminal, with the current in the first current path and the current in the second current path adding to the output current;

a feedback path for the output current which goes from the second terminal through a feedback resistor to a noninverting input of an operational amplifier, said noninverting input also receiving the control signal, andan output of the operational amplifier being connected to the base of the second bipolar transistor;

a first transistor, which renders the first bipolar transistor conductive after turn-on of the DC voltage source, and to which a start signal is applied at a control electrode as a result of the turn-on; and a second transistor, which turns the first transistor off after the end of the start phase, and to which a stop signal is applied at a control electrode after the end of the start phase.

In a first preferred embodiment of the first variant of the invention, the first bipolar transistor is a pnp transistor, and the second bipolar transistor is an npn transistor.

In a second preferred embodiment of the first variant of the invention, which embodiment can be used together with the first embodiment, the transistor is a P-channel junction-gate field-effect transistor whose drain terminal is connected to the collector of the second bipolar transistor and whose source terminal is connected to ground, and whose gate terminal is the control electrode.

In a third preferred embodiment of the first variant of the invention, which can also be used together with the first or second embodiment, the control signal applied to the operational amplifier is a pulse-width-modulated signal which is generated from the output signal of the transducer by a microprocessor after turn-on of the DC voltage source, and which is smoothed.

In a first preferred embodiment of the second variant of the invention, the first bipolar transistor is a pnp transistor and the second bipolar transistor is an npn transistor.

In a second preferred embodiment of the second variant of the invention, which embodiment can be used together with the first embodiment of the second variant, the first and second transistors are N-channel enhancement-mode insulated-gate field-effect transistors each having a drain, a source, and a gate terminal;

the gate terminal of the first transistor is connected through a fourth resistor in series with a third resistor to the base of the first bipolar transistor;

the drain terminal of the first transistor is connected through a fifth resistor in series with the fourth resistor to the base of the first bipolar transistor;

the source terminal of the first transistor is connected to ground;

the drain terminal of the second transistor is connected to the gate terminal of the first transistor;

the source terminal of the second transistor is connected to ground; and the gate terminal of the second transistor is connected to an output of a microprocessor which provides the stop signal.

In a third preferred embodiment of the second variant of the invention, which embodiment can also be used together with the second and/or third embodiments of this variant, the control signal applied to the operational amplifier is a pulse-width-modulated signal which is generated from the output signal of the transducer by a microprocessor and which is smoothed, In a fourth preferred embodiment of the second variant of the invention, which can also be used together with the first to the third embodiments of this variant, an output of a HART protocol transmitting stage is capacitively coupled to the noninverting input of the operational amplifier, this HART protocol transmitting stage serving to modulate a first HART protocol signal to be sent out of the two-wire measuring instrument upon the output current;

an input of a HART protocol receiving stage is capacitively coupled to the emitter of the first bipolar transistor, this HART protocol receiving stage serving to demodulate a HART protocol signal modulated upon the output current outside of, and to be received by, the two-wire measuring instrument; and the collector of the first bipolar transistor is coupled to a first terminal of a capacitor having its second terminal connected to ground.

According to a development of the fourth embodiment of the second variant of the invention, a second diode is inserted between the collector of the first bipolar transistor and the voltage regulator.

BRIEF DESCRIPTION OF THE DRAWINGS

The invention and its advantages will now be explained in more detail with reference to the accompanying drawings, which show embodiments of the invention. Identical reference characters have been used in the two figures to denote parts having similar functions.

DETAILED DESCRIPTION OF EXEMPLARY EMBODIMENTS

Figure 1:
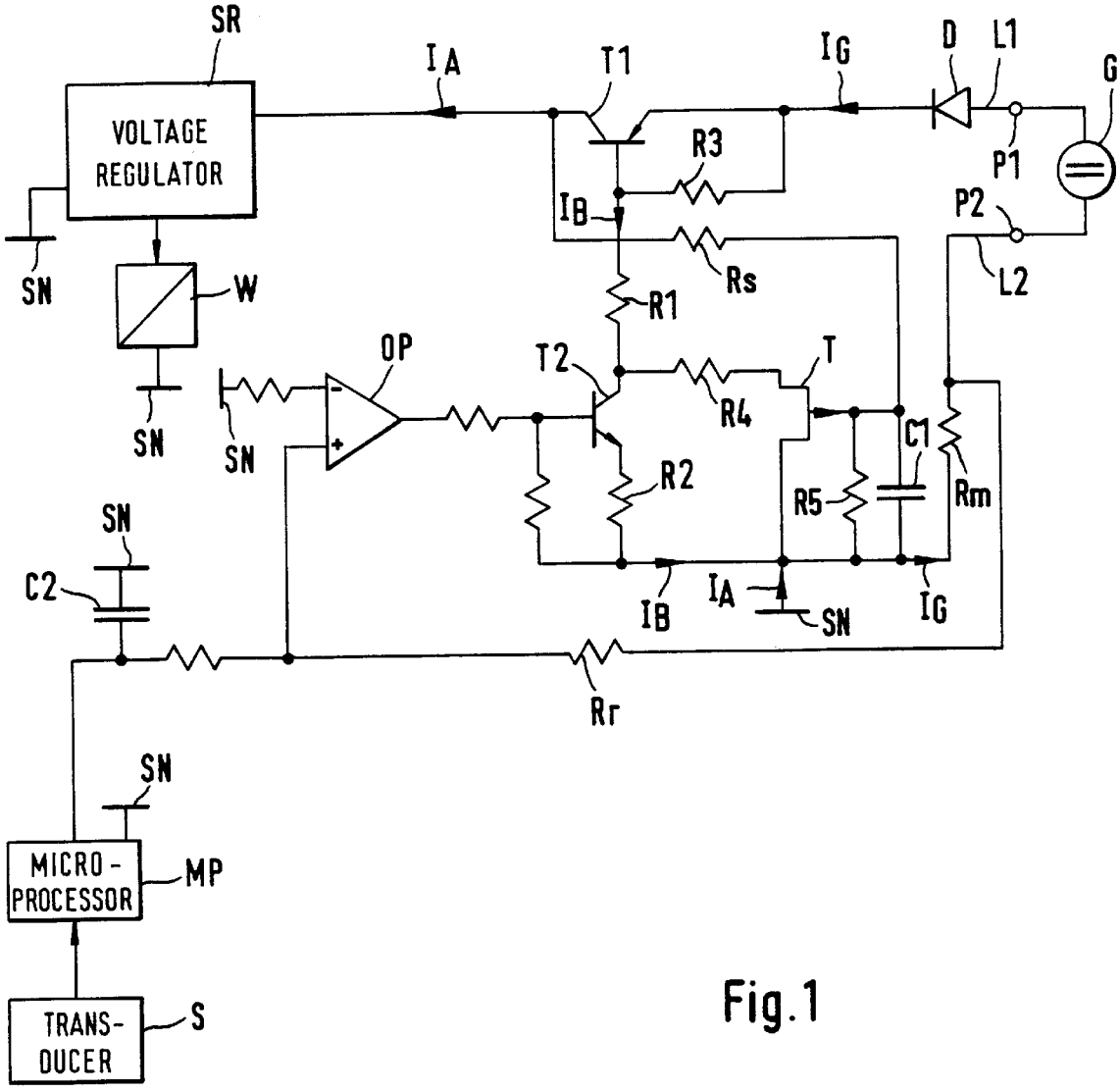
FIG. 1 shows, partly in block-diagram form, the circuit of a controlled current source of a two-wire instrument according to a first variant of the invention.

While the invention is susceptible to various modifications and alternative forms, exemplary embodiments thereof have been shown by way of example in the drawings and will herein be described in detail. It should be understood, however, that there is no intent to limit the invention to the particular forms desclosed, but on the contrary, the invention is to cover all modifications, equivalents, and alternatives falling within the spirit and scope of the invention as defined by the appended claims.

Referring to FIG. 1, there is shown, partly in block-diagram form, the circuit of a controlled current source according to a first variant of the invention. The controlled current source forms part of a two-wire measuring instrument, which has only a first wire L1 and a second wire L2 for providing an electric connection to the outside.

Wire L1 runs to a first terminal P1, and wire L2 runs to a second terminal P2. To supply power to the two-wire instrument, a DC voltage source G can be connected to terminals P1, P2; thus, as is usual, the DC voltage source G is thought of as being capable of being turned on and off, and has a no-load voltage of, e.g., 12 V to 30 V.

A first current path goes from the first terminal P1 through a diode D, an emitter-collector path of a first bipolar transistor T1, a voltage regulator SR connected to ground SN, and a grounded current-sensing resistor Rm to the second terminal P2. When DC voltage source G is connected to terminals P1, P2, and thus to wires L1, L2, the first current path is closed and a current $I_A$ flows therein.

In FIG. 1, bipolar transistor T1 is a pnp transistor, and bipolar transistor T2 is an npn transistor, with the positive and negative terminals of DC voltage source G connected to terminals P1 and P2, respectively. Since diode D must not impede the flow of output current $I_G$, it is forward-biased, i.e., in FIG. 1, the cathode of diode D is connected to the collector of bipolar transistor T1.

A second current path is from terminal P1 through diode D, the emitter-base path of bipolar transistor T1, a first resistor R1, a collector-emitter path of a second bipolar transistor T2, whose conductivity type is complementary to that of bipolar transistor T1, a second resistor R2, and current-sensing resistor Rm to terminal P2.

The second current path, too, is closed when DC voltage source G is connected to terminals P1, P2, and thus to wires L1, L2, and a current $I_B$ then flows in the second current path. Current $I_A$ and current $I_B$ add to the above-mentioned output current $I_G$; see the current arrows shown in FIG. 1.

The controlled current source further includes a feedback path for the output current $I_G$, which goes from terminal P2 through a feedback resistor Rr to a noninverting input of an operational amplifier OP. This input also receives a control signal, which determines the instantaneous output current value, which is dependent on a transducer output signal. An output of operational amplifier OP is connected to the base of bipolar transistor T2.

Because of this feedback, the controlled current source has the characteristics of a regulated current source, i.e., each current value, which is "forced" by the control signal, is held at a constant level, so that it is independent of any interference, particularly of fluctuations in the no-load voltage of the DC voltage source.

Also provided is a transistor T, which turns bipolar transistor T1 on after turn-on of DC voltage source G. A controlled current path of transistor T is connected in parallel with the emitter-collector path of bipolar transistor T2, and a control electrode of transistor T is connected to a tap of an RC section containing a series resistor Rs and a first capacitor C1. Series resistor Rs is connected to the collector of bipolar transistor T1, and capacitor C1 is connected to ground SN.

In FIG. 1, transistor T is preferably a P-channel junction-gate field-effect transistor whose drain terminal is connected to the collector of bipolar transistor T2 and whose source terminal is grounded. The gate terminal of transistor T is thus the aforementioned control electrode.

The control signal applied to the noninverting input of operational amplifier OP is preferably a pulse-width-modulated signal that was smoothed by a second capacitor C2; the still unsmoothed signal is generated after turn-on of DC voltage source G by a microprocessor MP from the transducer signal, which is provided by a physical-to-electrical transducer S.

The circuit diagram of FIG. 1 includes further resistors, which are not absolutely necessary for the basic operation of the circuit, but which support it. These are a third resistor R3, preferably of the order of 100 kΩ, which is connected in parallel with the emitter-base path of the bipolar transistor T1, a fourth resistor R4, which connects the drain terminal of transistor T to the collector of bipolar transistor T2, and a fifth resistor R5, which connects the gate terminal of transistor T to ground SN.

The circuit diagram of FIG. 1 further includes resistors that are not denoted by reference characters. Their functions are familiar to those skilled in the art, so that they need not be explained here. It can also be seen that an output of voltage regulator SR, which may be of a conventional type and is therefore shown only as a block, is connected to an input of a DC/DC converter W. The latter provides a voltage of sufficient level to operate micro-processor MP, operational amplifier OP, and, if necessary, transducer S.

The operation of the controlled current source of FIG. 1 is as follows. It is assumed that prior to the connection of DC voltage source G to terminals P1, P2 or, if the DC voltage source is permanently connected to these terminals, at turn-on of the DC voltage source, all energy-storing components of the two-wire instrument have been discharged. Thus, before the DC voltage source is turned on, the base of transistor T is connected through resistor R5 to ground potential SN.

After turn-on, this potential is held at this value for the time being, because capacitor C1 becomes charged only gradually through resistor Rs, so that transistor T is still conducting. Therefore, a voltage drop that is only slightly greater than ground potential SN appears across the controlled current path, i.e., the drain-source path, of transistor T. Thus, the voltage of DC voltage source G appears across the series combination of resistors R3, R1, R4, and the base of bipolar transistor T1 is at a potential which is negative enough in comparison with the potential of its emitter to render bipolar transistor T1 conductive.

After turn-on, capacitor C1 becomes gradually charged through resistor Rs, so that the potential at the gate terminal of transistor T increases until the latter is turned off. This turn-off is permissible, because transistor T has fulfilled its function as a turn-on circuit for starting the controlled current source, and this function is no longer needed. Thus, transistor T is traversed only by a leakage current that is negligible compared to current $I_B$~.

After bipolar transistor T1 has turned on and remains in the on state, bipolar transistor T2, because of resistor R2 in its emitter circuit, is biased so as to respond to the potential at the output of operational amplifier OP. Therefore, the potential at the base of bipolar transistor T1 is such that the value of output current æG corresponding to the instantaneous transducer signal is produced.

On the other hand, because of the conducting bipolar transistor T1, the first current path is enabled, so to speak, and the current $I_A$ is flowing, so that voltage regulator SR, DC/DC converter W, microprocessor MP and, if necessary, transducer S are supplied with power and are operational. Voltage regulator SR generates a voltage of, e.g., 10.5 V.

Figure 2:
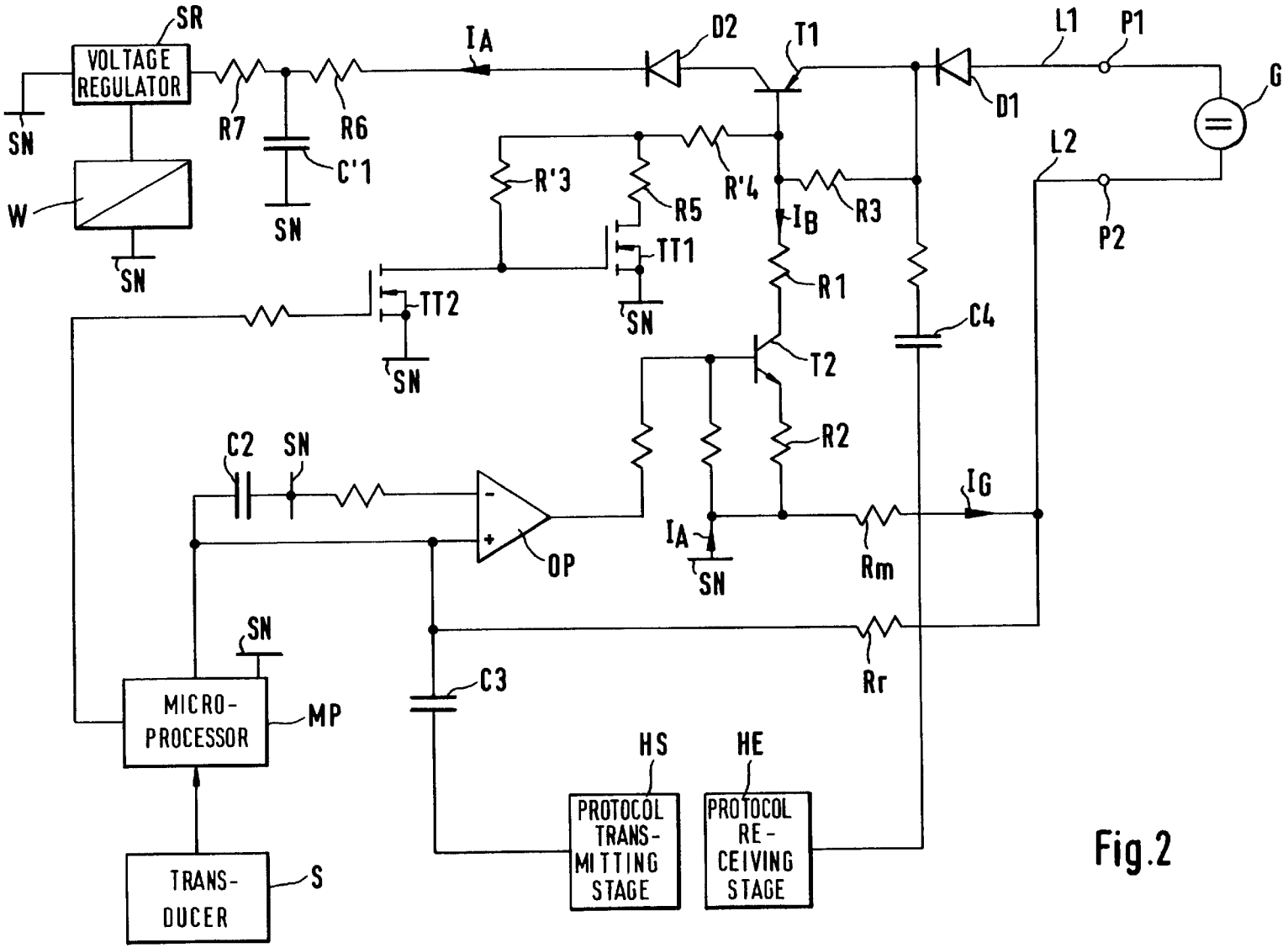
FIG. 2 shows, partly in block-diagram form, the circuit of a controlled current source of a two-wire instrument according to a second variant of the invention.

FIG. 2 shows, partly in block-diagram form, the circuit of a controlled current source of a two-wire instrument according to a second variant of the invention. In FIG. 2, components that are also present in FIG. 1 are designated by the same reference characters as in FIG. 1 if they are connected in the same way as in FIG. 1. If that is not the case, reference characters of FIG. 1 have been modified by an additional symbol (prime, star, etc.).

Compared with the first variant, shown in FIG. 1, the second variant, shown in FIG. 2, has been modified so that on the two wires L1, L2, the HART protocol can be transmitted. The HART protocol (HART is an acronym for "highway addressable remote transducer", i.e., for bus-addressed instruments) has been known and used in industrial measurement technology for a long time.

The HART protocol permits communications between a field level and a process control level with the advantage of allowing the simultaneous transmission of an analog measurement signal according to the 4- to 20-mA standard and the digitial HART signal for operating, starting up, maintaining, interrogating, or controlling the instruments at the field level.

While the analog mesaurement signal remains continuously available, cyclic interrogation and, if necessary, a subsequent instruction are effected by the digital HART signals, with a binary 0 and a binary 1 being implemented according to the standard Bell 202 frequency shift keying by two 2.2-kHz sine waves and a single 1.2-kHz sine wave, respectively. These sine waves are modulated on the output current $I_G$.

When the circuit of FIG. 1 was used together with the HART protocol and with a capacitor corresponding to capacitor C'1 of FIG. 2, it turned out that after turn-on, junction-gate field-effect transistor T was completely off, because its gate-source voltage could not be made positive enough (in practice not greater than 3 V at a gate-source threshold voltage of 2.8 V, which is required according to the data sheet to turn off the transistor type used).

This results in a small leakage current through transistor T, which does not interfere with the aforementioned current regulation if the HART protocol is not used. If the HART protocol is used, however, this leakage current may cause the communication between field level and process control level to be interrupted, since the charging and discharge of the capacitor corresponding to capacitor C'1 is disturbed.

This possible disadvantage of FIG. 1 is eliminated in the second variant of the invention, shown in FIG. 2, which is therefore modified in comparison with the first variant as follows.

In FIG. 2, the first current path is from terminal P1 through a first diode D1, the emitter-collector path of bipolar transistor T1, voltage regulator SR, which is connected to ground SN, a second diode D2, two series connected resistors R6, R7 (being optional, see below) and current-sensing resistor Rm, also connected to ground SN, to the second terminal P2 of DC voltage source G. The emitter-collector path of bipolar transistor T1 is again shunted by resistor R3. When DC voltage source G is connected to terminals P1, P2, and thus to wires L1, L2, the first current path is closed and the current $I_A$ flows therein.

The second current path is from the first terminal P1 through diode Di, the emitter-base path of bipolar transistor T1, resistor R1, the collector-emitter path of bipolar transistor T2, whose conductivitiy type is again complementary to that of bipolar transistor T1, resistor R2, and current-sensing resistor Rm to terminal P2. Thus, the current $I_B$ flows again, which adds to the current $I_A$, so that the output current $I_G$ is formed.

In FIG. 2, too, bipolar transistor T1 is a pnp transistor, and bipolar transistor T2 is an npn transistor, with the positive and negative terminals of DC voltage source G connected to terminals P1 and P2, respectively.

The collector of bipolar transistor T1 and, consequently, the input of voltage regulator SR are coupled to a first terminal of a first capacitor C'1, whose second terminal is connected to ground SN. If, as assumed in the circuit arrangement of FIG. 1, the two-wire instrument meets explosion protection standards, two low-value resistors R6, R7 (preferably about 50 Ω) are inserted, so that together with the capacitor C'1, the T-section shown is obtained. The two resistors R6, R7 prevent an ignition spark from being produced in the event of a circuit break in the instrument.

The controlled current source of FIG. 2, too, includes the feedback path for the output current æGI which goes from terminal P2 through feedback resistor Rr to the noninverting input of the operational amplifier OP. This input also receives a control signal, which determines the instantaneous value of the output current $I_G$, which is dependent on the transducer signal. An output of operational amplifier OP is connected to the base of bipolar transistor T2. Because of this feedback, the controlled current source has the above-explained characteristics of a regulated current source.

Also provided is a first transistor TT1, which turns bipolar transistor T1 on after turn-on of DC voltage source G, and to which a start signal is applied at a control electrode as a result of the turn-on. Furthermore, a second transistor TT2 is provided, which turns the first transistor TT1 off at the end of the start phase, when a stop signal provided by microprocessor MP is applied to its control electrode.

In FIG. 2, transistors TT1, TT2 are preferably N-channel enhancement-mode insulated-gate field-effect transistors with a drain, a source, and a gate terminal. The gate terminal of transistor TT1 is connected through a series combination of a third resistor R'3 and a fourth resistor R'4 to the base of bipolar transistor T1.

The drain terminal of transistor TT1 is connected through a series combination of a fifth resistor R5 and resistor R'4 to the base of bipolar transistor T1, and the source terminal of the first transistor TT1 is connected to ground SN.

The drain terminal of transistor TT2 is connected to the gate terminal of transistor T1, the source terminal of transistor TT2 is grounded, and the gate terminal of transistor TT2 is connected to the stop signal output of microprocessor MP.

In FIG. 2, too, the control signal applied to the noninverting input of operational amplifier OP is preferably a pulse-width-modulated signal smoothed by capacitor C2, which signal is generated by microprocessor MP from the unsmoothed transducer signal after turn-on of DC voltage source G; the transducer signal is again provided by the physical-to-electrical transducer S.

To enable the regulated current source to generate and process the HART protocol, subcircuits are provided, which will now be explained. An output of a HART protocol transmitting stage HS, which modulates a first HART protocol signal, to be sent out of the two-wire instrument, is capactively coupled through a third capacitor C3 to the noninverting input of operational amplifier OP. An input of a HART protocol receiving stage HE, which modulates a second HART protocol signal, which is modulated on the total current $I_G$ outside of the two-wire instrument and is to be received by the latter, is capacitively coupled through a fourth capacitor C4 to the emitter of bipolar transistor T1. Such transmitting and receiving stages have been in common use for a long time, so that they need not be explained here in greater detail.

Capacitor C'1, as mentioned, serves to compensate for the power supply variations caused by the HART protocol signals. It becomes charged during the positive half cycles of these signals and discharges during their negative half cycles through voltage regulator SR; thus, the supply of power to the latter is maintained even during these negative parts.

Preferably, a second diode D2, whose forward direction, like that of diode Di, is the same as the direction of the current $I_A$, is inserted between the collector of bipolar transistor T1 and voltage regulator SR; thus, the anode of diode D2 is connected to the collector of bipolar transistor T1. Diode D2 prevents capacitor C'1 from discharging via the collector-base path of bipolar transitor T1 after turn-off of DC voltage source G, so that thereafter, micro-processor MP remains operational for some time and can, for example, execute any routines that may still be necessary, particularly a totalizing function.

The circuit diagram of FIG. 2, too, includes resistors not provided with reference characters, whose functions are familiar to those skilled in that art, so that they need not be explained here. Like in FIG. 1, an output of voltage regulator SR, a conventional type in this variant also, is connected to the input of DC/DC converter W.

The operation of the controlled current source of FIG. 2 is as follows. It is again assumed that prior to the connection of DC voltage source G to terminals P1, P2 or, if the DC voltage source is permanently connected to these terminals, at the turning on of this source, all energy-storing components of the two-wire instrument are discharged.

After turn-on, a voltage is developed across resistors R'3, R'4 and appears at the gate terminal of transistor TT1, because transistor TT2 is off, so that its drain voltage is approximately equal to the potential at terminal P1; in FIG. 2, therefore, this potential is highly positive, since the potential at the gate terminal of transistor TT2 is still equal to ground potential SN, because microprocessor MP cannot be active until voltage regulator SR has become active.

As soon as the voltage at the gate terminal of transistor TT1 suffices to turn the latter on, a current path from terminal P1 through the emitter-base path of npn bipolar transistor T1, resistors R'4, R'3, and the drain-source path of transistor TT1 to ground SN is completed. As a result, the potential at the base of bipolar transistor T1 becomes sufficiently negative in comparison with the potential at the emitter of this transistor to turn the latter on. Thus, the first current path is enabled as well, the current æA is flowing, and voltage regulator SR as well as microprocessor MP begin to operate.

Thus, microprocessor MP provides, at the output connected to the gate terminal of transistor TT2, the aforementioned stop signal, which, in the embodiment of FIG. 2, is so positive during operation of the two-wire instrument that transistor TT2 is constantly on. As a result, transistor TT1 is constantly off, so that only a current negligible compared with current $I_B$, if any, can flow in the current path provided by this transistor, which current path is parallel to the second current path. Thus, only the currents $I_A$, $I_B$ flow in the two-wire instrument.

The above-mentioned HART signal, which in the case of the invention represents a current modulation, can take on maximum current values of ±600 $\mu$A. This means in the worst case, if the output current $I_G$ is 4 mA, that only (4±0.6) mA=(3.4 to 4.6) mA are available for power supply. The above-mentioned evaluation electronics are designed to draw a maximum current, namely the current $I_A$, of 3.9 mA. Accordingly, the 3.4 mA that are available during the negative half cycles of HART signals being transmitted or received do not suffice, so that communication using the HART protocol could be interrupted.

This disadvantage is eliminated by means of capacitor C'1. Capacitor C'1 becomes charged during the positive half cycles of the HART signals, i.e., when 4.6 mA are available, and thus delivers the missing power during the negative cycles, when only 3.4 mA are available. Communication via the HART signal can thus function without interruption and in a perfect manner.

The fact that the current $I_B$, which turns transistor T1 on, flows through resistors R'4 and R'5 and the drain-source path of transistor TT1 to ground SN and then through current-measuring resistor Rm to terminal P2 prevents operational amplifier OP, which in FIG. 2 is fed by a positive voltage from DC/DC converter W, from receiving such a high negative voltage as to be blocked, i.e., as to be driven into a latch-up mode, which must always be avoided.

The feedback through feedback resistor Rr to the noninverting input of operational amplifier OP is a negative feedback, whose effect is more or less compensated for during operation by the smoothed, pulse-width-modulated voltage.

When DC voltage source G is turned on, however, this voltage is not yet present, and without transistors TT1, TT2 and the components connected to them, the voltage at the noninverting input of operational amplifier OP would be so negative that the latter would be driven into the latch-up mode, because operational amplifier OP is fed not by a voltage symmetrical with respect to ground SN, i.e., by a positive and a negative voltage, but only by a positive voltage.

In the latch-up mode, operational amplifier OP would be overdriven and, as a result, bipolar transistor T2 would be in saturation, so that the two-wire instrument could not start; the current $I_A$ would be between 22 mA and 60 mA.

If, however, the current æAl which renders bipolar transistor T1 conductive, flows through resistors R'4, R5, the drain-source path of transistor TT1 to ground SN and then through current-sensing resistor Rm to terminal P2 at turn-on, the starting current, i.e., the current shortly after turn-on of DC voltage source G, will be a maximum of 41 $\mu$A to 108 $\mu$A. The instantaneous starting current value is dependent on the instantaneous voltage value of DC voltage source G and the respective voltage drops across diode D1, across the emitter-base junction of bipolar transistor D1, and across resistors R'3, R'4, and Rm.

This means that the negative voltage that is fed through feedback resistor Rr back to the noninverting input of operational amplifier OP ranges between −1.8 mV and −4.7 mV. Such values, however, do not suffice to drive conventional operational amplifiers into the latch-up mode.

While the invention has been illustrated and described in detail in the drawing and foregoing description, such illustration and description is to be considered as exemplary and not restrictive in character, it beeing understood that only exemplary embodiments have been shown and described and that all changes and modifications that come within the spirit of the invention are desired to be protected.

What is claimed is:

1. A controlled current source of a two-wire meas-uring instrument which generates a measurement signal in the form of an output current between 4 mA and 20 mA and which is controlled by a control signal derived from an output signal of a physical-to-electrical transducer, said controlled current source comprising:

a first current path, which goes from a first terminal of a DC voltage source, to be connected from outside, via a diode, an emitter-collector path of a first bipolar transistor, a voltage regulator connected to ground, and a grounded current-sensing resistor to a second terminal of the DC voltage source;

a second current path, which goes from the first terminal via the diode, the emitter-base path of the first bipolar transistor, a first resistor, a collector-emitter path of a second bipolar transistor, whose conductivity type is complementary to that of the first bipolar transistor, a second resistor, and the current-sensing resistor to the second terminal, with the current in the first current path and the current in the second current path adding to the output current;

a feedback path for the output current which goes from the second terminal through a feedback resistor to a noninverting input of an operational amplifier, said noninverting input also receiving the control signal, and an output of the operational amplifier being connected to the base of the second bipolar transistor; and a transistor which renders the first bipolar transistor conductive after turn-on of the DC voltage source, said transistor having its controlled current path connected in parallel with the emitter-collector path of the second bipolar transistor and having its control electrode connected to a tap of a first RC section, containing a series resistor and a first capacitor, the series resistor being connected to the collector of the first bipolar transistor, and the capacitor being connected to ground.

2. The controlled current source as claimed in claim 1 wherein the first bipolar transistor is a pnp transistor, and the second bipolar transistor is an npn transistor.

3. The controlled current source as claimed in claim 2 wherein the transistor is a P-channel junction-gate field-effect transistor whose drain terminal is connected to the collector of the second bipolar transistor and whose source terminal is connected to ground, and whose gate terminal is the control electrode.

4. The controlled current source as claimed in claim 2 wherein the control signal applied to the operational amplifier is a pulse-width-modulated signal which is generated from the output signal of the transducer by a microprocessor after turn-on of the DC voltage source, and which is smoothed.

5. The controlled current source as claimed in claim 3 wherein the control signal applied to the operational amplifier is a pulse-width-modulated signal which is generated from the output signal of the transducer by a microprocessor after turn-on of the DC voltage source, and which is smoothed.

6. A controlled current source of a two-wire measuring instrument which generates a measurement signal in the form of an output current between 4 mA and 20 mA and which is controlled by a control signal derived from an output signal of a physical-to-electrical transducer, said controlled current source comprising:

a first current path, which goes from a first terminal of a DC voltage source, to be connected from outside, via a first diode, an emitter-collector path of a first bipolar transistor, a voltage regulator connected to ground, and a grounded current-sensing resistor to a second terminal of the DC voltage source;

a second current path, which goes from the first terminal via the first diode, the emitter-base path of the first bipolar transistor, a first resistor, a collector-emitter path of a second bipolar transistor, whose conductivity type is complementary to that of the first bipolar transistor, a second resistor, and the current-sensing resistor to the second terminal, with the current in the first current path and the current in the second current path adding to the output current;

a feedback path for the output current which goes from the second terminal through a feedback resistor to a noninverting input of an operational amplifier, said noninverting input also receiving the control signal, andan output of the operational amplifier being connected to the base of the second bipolar transistor;

a first transistor, which renders the first bipolar transistor conductive after turn-on of the DC voltage source, and to which a start signal is applied at a control electrode as a result of the turn-on; and a second transistor, which turns the first transistor off after the end of the start phase, and to which a stop signal is applied at a control electrode after the end of the start phase.

7. The controlled current source as claimed in claim 6 wherein the first bipolar transistor is a pnp transistor and the second bipolar transistor is an npn transistor.

8. The controlled current source as claimed in claim 6 wherein the first and second transistors are N-channel enhancement-mode insulated-gate field-effect transistors each having a drain, a source, and a gate terminal;

the gate terminal of the first transistor is connected through a fourth resistor in series with a third resistor to the base of the first bipolar transistor;

the drain terminal of the first transistor is connected through a fifth resistor in series with the fourth resistor to the base of the first bipolar transistor;

the source terminal of the first transistor is connected to ground;

the drain terminal of the second transistor is connected to the gate terminal of the first transistor;

the source terminal of the second transistor is connected to ground; and the gate terminal of the second transistor is connected to an output of a microprocessor which provides the stop signal.

9. The controlled current source as claimed in claim 6 wherein the control signal applied to the operational amplifier is a pulse-width-modulated signal which is generated from the output signal of the transducer by a microprocessor and which is smoothed.

10. The controlled current source as claimed in claim 7 wherein the control signal applied to the operational amplifier is a pulse-width-modulated signal which is generated from the output signal of the transducer by a microprocessor and which is smoothed.

11. The controlled current source as claimed in claim 8 wherein the control signal applied to the operational amplifier is a pulse-width-modulated signal which is generated from the output signal of the transducer by a microprocessor and which is smoothed.

12. The controlled current source as claimed in claim 6 wherein an output of a HART protocol transmitting stage is capacitively coupled to the noninverting input of the operational amplifier, this HART protocol transmitting stage serving to modulate a first HART protocol signal to be sent out of the two-wire measuring instrument upon the output current;

an input of a HART protocol receiving stage is capacitively coupled to the emitter of the first bipolar transistor, this HART protocol receiving stage serving to demodulate a HART protocol signal modulated upon the output current outside of, and to be received by, the two-wire measuring instrument; and the collector of the first bipolar transistor is coupled to a first terminal of a capacitor having its second terminal connected to ground.

13. The controlled current source as claimed in claim 7 wherein an output of a HART protocol transmitting stage is capacitively coupled to the noninverting input of the operational amplifier, this HART protocol transmitting stage serving to modulate a first HART protocol signal to be sent out of the two-wire measuring instrument upon the output current;

an input of a HART protocol receiving stage is capacitively coupled to the emitter of the first bipolar transistor, this HART protocol receiving stage serving to demodulate a HART protocol signal modulated upon the output current outside of, and to be received by, the two-wire measuring instrument; and the collector of the first bipolar transistor is coupled to a first terminal of a capacitor having its second terminal connected to ground.

14. The controlled current source as claimed in claim 8 wherein an output of a HART protocol transmitting stage is capacitively coupled to the noninverting input of the operational amplifier, this HART protocol transmitting stage serving to modulate a first HART protocol signal to be sent out of the two-wire measuring instrument upon the output current;

an input of a HART protocol receiving stage is capacitively coupled to the emitter of the first bipolar transistor, this HART protocol receiving stage serving to demodulate a HART protocol signal modulated upon the output current outside of, and to be received by, the two-wire measuring instrument; and the collector of the first bipolar transistor is coupled to a first terminal of a capacitor having its second terminal connected to ground.

15. The controlled current source as claimed in claim 9 wherein an output of a HART protocol transmitting stage is capacitively coupled to the noninverting input of the operational amplifier, this HART protocol transmitting stage serving to modulate a first HART protocol signal to be sent out of the two-wire measuring instrument upon the output current;

an input of a HART protocol receiving stage is capacitively coupled to the emitter of the first bipolar transistor, this HART protocol receiving stage serving to demodulate a HART protocol signal modulated upon the output current outside of, and to be received by, the two-wire measuring instrument; and the collector of the first bipolar transistor is coupled to a first terminal of a capacitor having its second terminal connected to ground.

16. The controlled current source as claimed in claim 10 wherein an output of a HART protocol transmitting stage is capacitively coupled to the noninverting input of the operational amplifier, this HART protocol transmitting stage serving to modulate a first HART protocol signal to be sent out of the two-wire measuring instrument upon the output current;

an input of a HART protocol receiving stage is capacitively coupled to the emitter of the first bipolar transistor, this HART protocol receiving stage serving to demodulate a HART protocol signal modulated upon the output current outside of, and to be received by, the two-wire measuring instrument; and the collector of the first bipolar transistor is coupled to a first terminal of a capacitor having its second terminal connected to ground.

17. The controlled current source as claimed in claim 11 wherein an output of a HART protocol transmitting stage is capacitively coupled to the noninverting input of the operational amplifier, this HART protocol transmitting stage serving to modulate a first HART protocol signal to be sent out of the two-wire measuring instrument upon the output current;

an input of a HART protocol receiving stage is capacitively coupled to the emitter of the first bipolar transistor, this HART protocol receiving stage serving to demodulate a HART protocol signal modulated upon the output current outside of, and to be received by, the two-wire measuring instrument; and the collector of the first bipolar transistor is coupled to a first terminal of a capacitor having its second terminal connected to ground.

18. The controlled current source as claimed in claim 12 wherein a second diode is inserted between the collector of the first bipolar transistor and the voltage regulator.

19. The controlled current source as claimed in claim 13 wherein a second diode is inserted between the collector of the first bipolar transistor and the voltage regulator.

20. The controlled current source as claimed in claim 14 wherein a second diode is inserted between the collector of the first bipolar transistor and the voltage regulator.

21. The controlled current source as claimed in claim 15 wherein a second diode is inserted between the collector of the first bipolar transistor and the voltage regulator.

22. The controlled current source as claimed in claim 16 wherein a second diode is inserted between the collector of the first bipolar transistor and the voltage regulator.

23. The controlled current source as claimed in claim 17 wherein a second diode is inserted between the collector of the first bipolar transistor and the voltage regulator.

* * * * *